US005524963A

United States Patent [19]

Barile

[11] Patent Number: 5,524,963

[45] Date of Patent: Jun. 11, 1996

[54] STACKING INTERFACE DEVICE FOR CHAIRS

[75] Inventor: Peter Barile, Hamblen County, Tenn.

[73] Assignee: Shelby Williams Industries, Inc., Morristown, Tenn.

[21] Appl. No.: 353,058

[22] Filed: Dec. 9, 1994

[51] Int. Cl.[6] ..... A47C 3/04

[52] U.S. Cl. ..... 297/239; 297/463.1; 211/194

[58] Field of Search ..... 297/239, 463.1; 211/194

[56] References Cited

U.S. PATENT DOCUMENTS 3,031,227 4/1962 Van Buren, Jr. ..... 297/239

3,856,352 12/1974 Jacobi, Sr. ..... 297/239 X

*Primary Examiner*—Peter M. Cuomo

*Assistant Examiner*—Rodney B. White

*Attorney, Agent, or Firm*—Pitts & Brittian

[57] ABSTRACT

A stacking interface device (10) for altering the stacked disposition of a chair (12) to facilitate the stable stacking of such chair on other chairs. The stacking interface device (10) includes an interface body (14) for being secured beneath the seat bottom (16) of a chair (12), the interface body (14) having a forward portion (18) and a rearward portion (20). The interface body (14) also defines a lower surface (22) for supporting the chair upon the seat cushion (24) of a second chair (12). The lower surface (22) of the interface body (14) is disposed at an angle relative to the lower surface (26) of the seat bottom (16) of the chair to which the device (10) is attached such that the distance between the lower surface (22) of the interface body (14) and the lower surface (26) of the seat bottom of the chair decreases from the forward portion (18) of the interface body to the rearward portion (20) of the interface body (14).

10 Claims, 4 Drawing Sheets

STACKING INTERFACE DEVICE FOR CHAIRS

TECHNICAL FIELD

This invention relates to a stacking interface device for stackable chairs which is carried on the seat bottoms of the chairs to facilitate stacking. In this particular invention the stacking interface device includes an interface body for being secured on the seat bottom of a chair, with the interface body being provided with a selectively angled lower surface for supporting the chair on the seat cushion of another chair.

BACKGROUND ART

When most conventional chairs are stacked for storage there is a tendency with the addition of each additional chair to the stack for the center of gravity of the stack to shift forward. In this regard, a stack of chairs is supported on the legs of the bottom most chair and the seat back of each successive chair in the stack is dispose in front of the seat back of the chair on which it is stacked. Thus, as chairs are added to the stack a disproportionate amount of the additional weight is disposed forward of the normal center of gravity of the lower most chair. As a result the stack can become unstable if too many chairs are added to the stack, and can easily be tipped over. Indeed, the stack may topple on its own if the center of gravity of the stack is disposed too far forward.

Further, when typical stackable chairs are stacked the lower surface of the seat bottom of one chair is supported on the seat cushion of the chair below it. However, the leg members of most stackable chairs are secured to the lower surface of the seat portion, and the lower surface of such chairs can define other irregular features. As a result, it is common for impressions of the legs and/or other irregular features of the lower surface of the seat bottoms to remain in the seat cushions of the chairs when they are un-stacked. These impressions are aesthetically undesirable, and over time damage can result, requiring replacement of the cushion or replacement of the chair.

Therefore, it is an object of the present invention to provide a stacking interface device for chairs which is carried on the seat bottom of a chair to facilitating the stacking of such chair.

It is another object of the present invention to provide a stacking interface device which allows a greater number of chairs to be stacked for storage without the stack becoming unstable.

Yet another object of the present invention is to provide a stacking interface device which obviates the problem of seat bottom impressions being left in the seat cushions when chairs are un-stacked.

Still another object of the present invention is to provide a stacking interface device which is easy and inexpensive to manufacture and maintain.

SUMMARY OF THE INVENTION

The present invention provides a stacking interface device for altering the stacked disposition of a chair to facilitate the stable stacking of such chair on other chairs. The stacking interface device includes an interface body for being secured beneath the seat bottom of a stackable chair, the interface body having a forward portion and a rearward portion. The interface body also defines a lower surface for supporting the stackable chair upon the seat cushion of a second stackable chair. The lower surface of the interface body is disposed at an angle relative to the lower surface of the seat bottom of the chair to which the device is attached such that the distance between the lower surface of the interface body and the lower surface of the seat bottom of the chair decreases from the forward portion of the interface body to the rearward portion of the interface body. As a consequence of the chair being supported on the selectively angled lower surface of the interface body, rather than on the lower surface of the seat bottom of the chair, the stacked disposition of the chair relative to the chair upon which it is stacked is altered such that the forward shift of the center of gravity of a resulting stack of chairs is reduced.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

A stacking interface device incorporating various features of the present invention is illustrated generally at 10 in the Figures. As is discussed in detail below the device 10 is designed to be carried on the lower surface of a stackable chair 12 in order to optimize the stacked disposition of the chair 12 relative to the chair 12 on which it is stacked such that a large number of chairs can be stacked without the stack becoming unstable.

Figure 1:
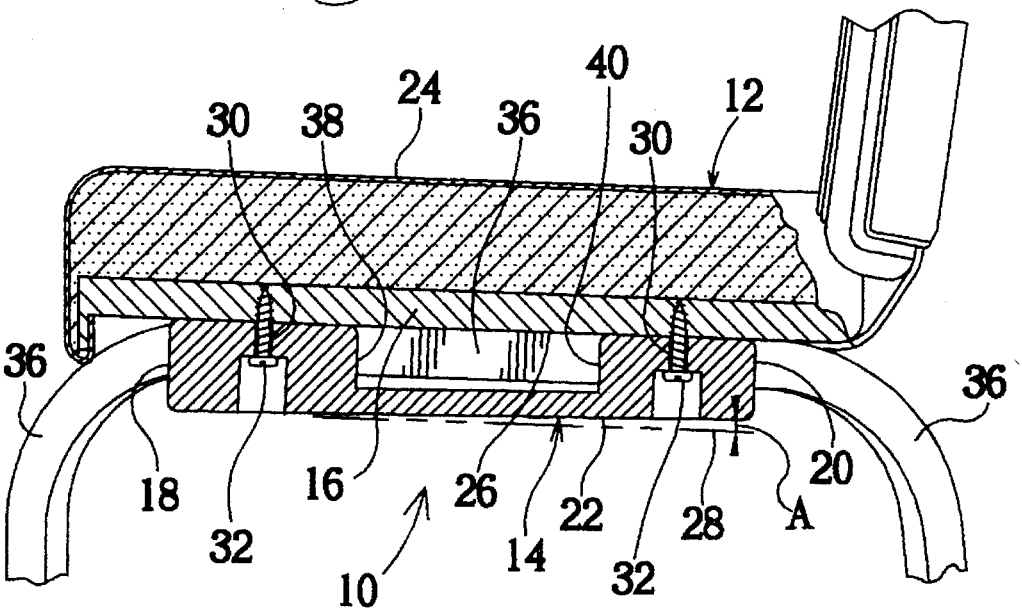
FIG. 1 illustrates a side elevation view, in section, of a stacking interface device of the present invention as installed on a chair.
Figure 2:
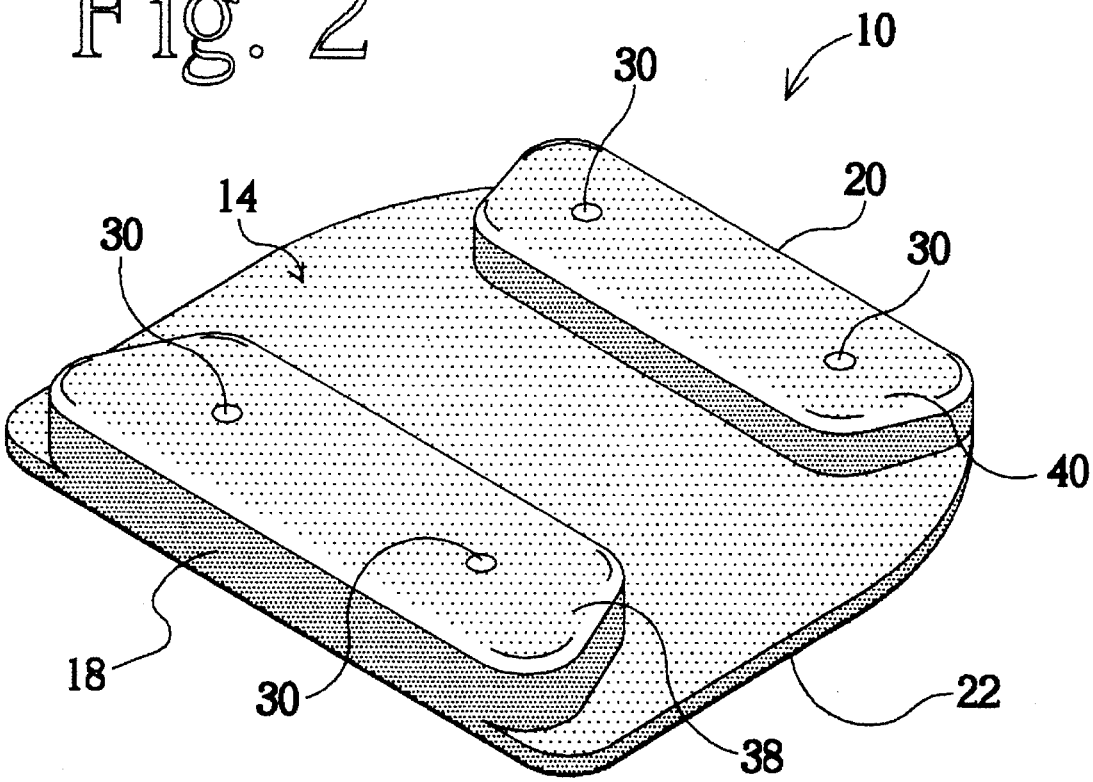
FIG. 2 illustrates a perspective view of a stacking interface device of the present invention.
Figure 3:
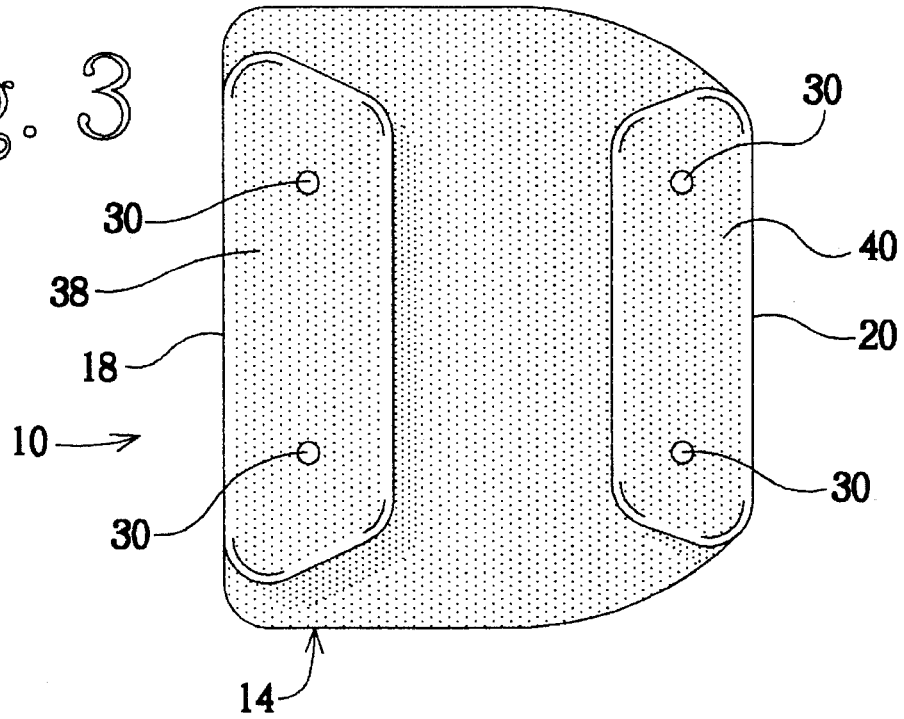
FIG. 3 illustrates a top plan view of a stacking interface device of the present invention.
Figure 4:
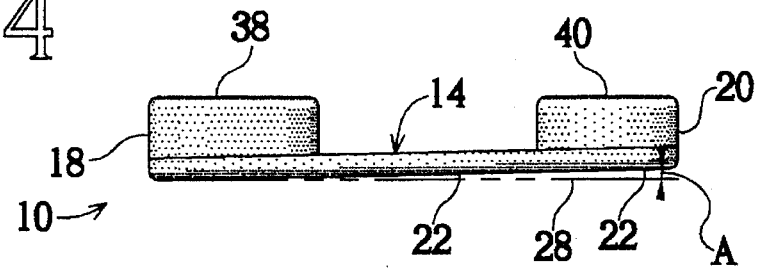
FIG. 4 illustrates a side elevation view of a stacking interface device of the present invention.
Figure 5:
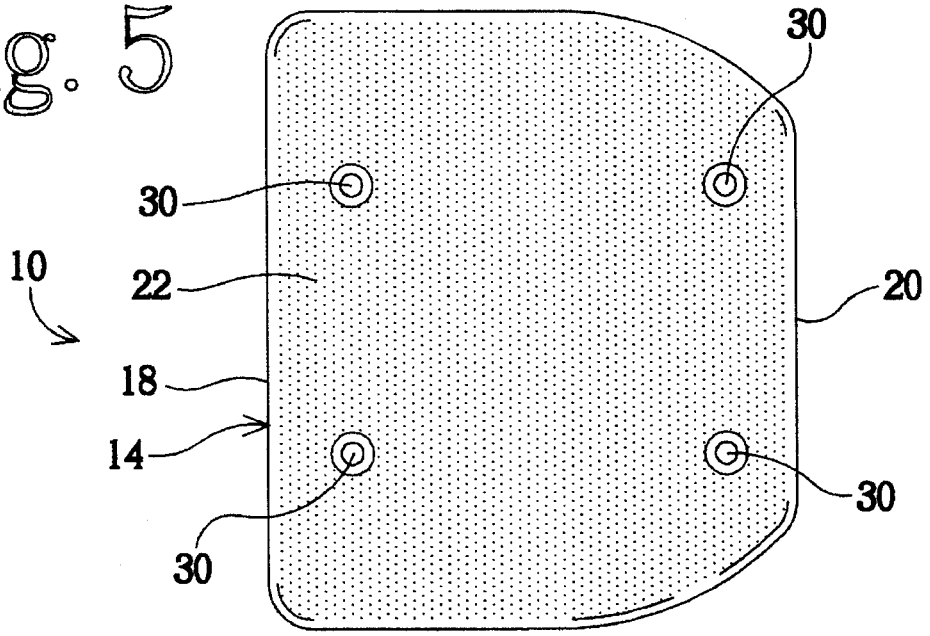
FIG. 5 illustrates a bottom view of a stacking interface device of the present invention.

The device 10 includes an interface body 14 which is secured to the seat bottom 16 of the chair 12. The body 14 has a forward portion 18 and a rearward portion 20, and defines a substantially planar lower surface 22 for engaging the seat cushion 24 of the chair 12 on which it is stacked. As best illustrated in FIG. 1, when the body 14 is secured to the seat bottom 16, the lower surface 22 of the interface body 14 is disposed at an angle relative to the lower surface 26 of the seat bottom 16 such that the distance between the lower surface 22 and the lower surface 26 decreases from the forward portion 18 of the body 14 to the rearward portion 20 of the body 14. As a result, the lower surface 22 is disposed at a selected angle A relative to a plane 28 which is parallel to the lower surface 26 of the seat bottom 16. The value of the angle A can vary, but typically the angle A is between 3° and 5°.

Figure 6:
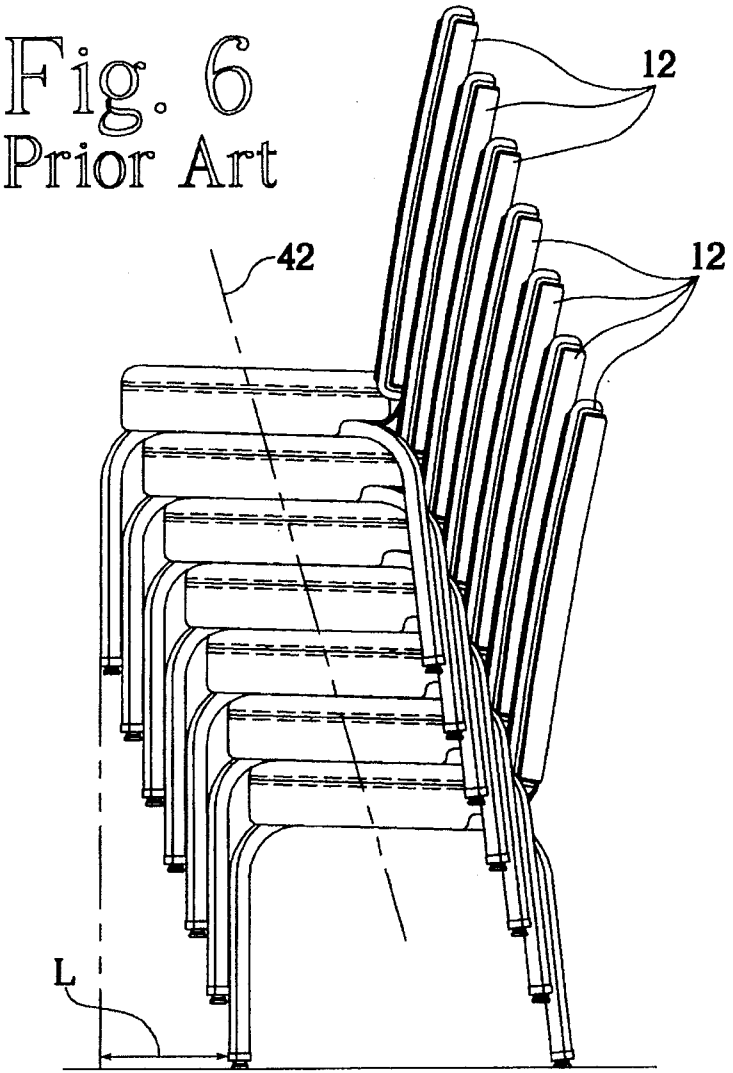
Fig. 6 Prior Art
FIG. 6 illustrates a plurality of stacked chairs which do not carry the stacking interface devices of the present invention.

It will be recognized that the disparate angular disposition of the lower surface 22 relative to the lower surface 26 of the seat bottom 16 results in an alteration of the angular disposition of a chair 12 relative to the chair 12 upon which it is stacked. In this regard, in FIG. 6 six (6) chairs 12 which are not provide with the stacking interface device 10 be are illustrated in a stacked configuration with the portion of the leg members 36 which engage the seat bottom 16 serving to support each chair on the seat cushion 24 of the chair below. In this stacked configuration the center of gravity of the stack shifts forward in a substantially linear path with the addition of each chair to the stack, such path being approximated by the line 42 in FIG. 6. As a consequence, relatively few chairs can be stacked without the stack becoming unstable and susceptible to being tipped over.

Figure 7:
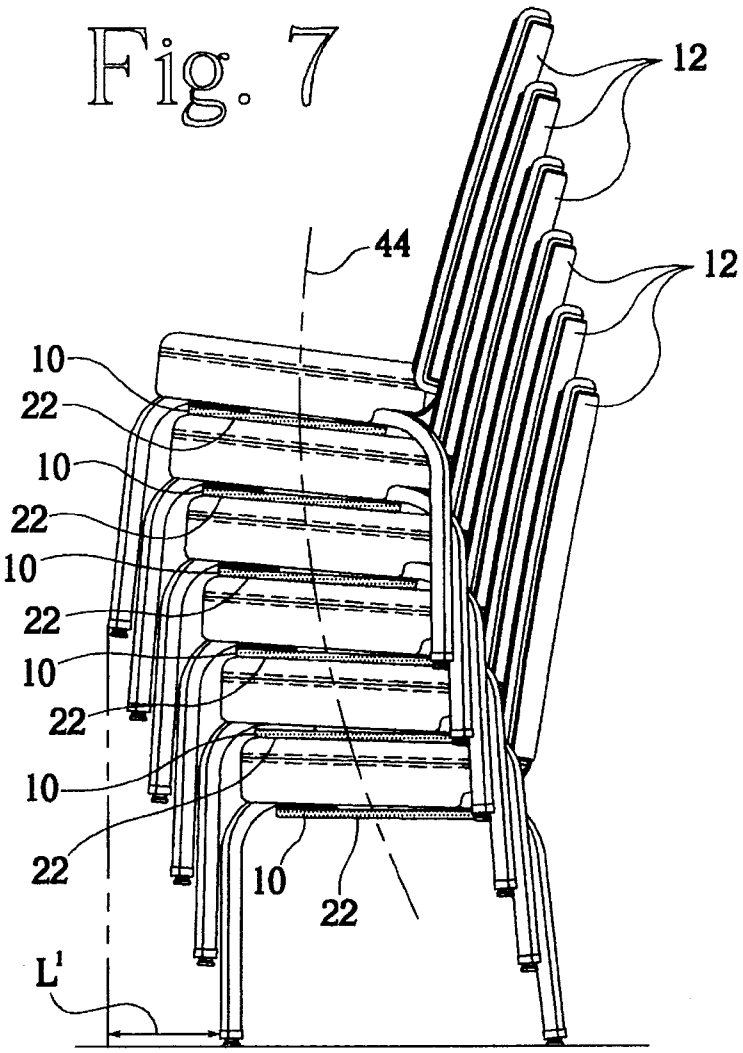
FIG. 7 illustrates a plurality of stacked chairs which carry the stacking interface device of the present invention.

By way of comparison, in FIG. 7 six (6) chairs 12 carrying stacking interface devices 10 are illustrated in a stacked configuration. Because the stacked chairs 12 of FIG. 7 are supported on the selectively angled lower surfaces 22 of the devices 10, the angular disposition of each stacked chair is altered relative to the chair 12 upon which it is stacked with the effect generally being a rearward tilting of each stacked chair 12 relative to the chair on which it is supported. Accordingly, as chairs are added to the stack, the center of gravity of the stack shifts forward, but the shift is in an arcuate path, as approximated by the path of the line 44 in FIG. 7, which results in an overall decrease in the forward shift relative to that seen in FIG. 6.

Indicative of this decrease is the decrease in the forward migration of the chairs when in a stacked disposition. For example, the distance L in FIG. 6, which is indicative of the forward migration of the chairs 12 with the stacking of six chairs not carrying the interface device 10, is substantially greater than the distance L' in FIG. 7, which is indicative of the forward migration of the chairs 12 with the stacking of six chairs which carry the interface devices 10. Therefore, when the interface devices 10 are used a greater number of chairs 12 can be stacked before the stack become unstable, and a greater number of chairs can be safely stored in a particular area.

Various mechanisms can be used to secure the interface body 14 to the seat bottom 16, however, in the preferred illustrated embodiment of FIGS. 1–5 the body 14 defines at least two spacing members 38 and 40 which engage the lower surface 26 of the seat bottom 16 and maintain the lower surface 22 of the device 10 at the desired angular disposition relative to the lower surface 26. Further, a plurality of holes 30 are provided in the interface body 14 for receiving threaded fasteners, such as the screws 32 (see FIG. 1), which threadably engage the seat bottom 16. However, other fastening means, such as an adhesive, can be used if desired.

It will be noted that the spacing members 38 and 40 allow the device 10 to be mounted such that the portion of the leg members 36 of the chair 12 which engage the seat bottom 16 are covered by the interface body 14. Accordingly, the leg members 36 of the chair 12 do not engage the seat cushion 24 of the chair 12 upon which it rests when the chair is stacked. Instead the lower surface 22 of the interface body 14 support the chair 12 on the chair below it, and no unsightly chair bottom impressions are left in the seat cushion 24 when the chairs 12 are un-stacked.

It is contemplated that the stacking interface device 10 can be fabricated of a plastic material, and vacuum molded into the desired configuration, but various durable fabricating materials can be used such as, for example, wood. Further, whereas the various components of the interface body 14 are illustrated in the Figures as being integrally formed it will be understood that this is merely illustrative of one preferred embodiment. For example, it is contemplated that the spacing members 38 and 40 can be separate components which are secured to the remainder of the interface body 14.

Figure 8:
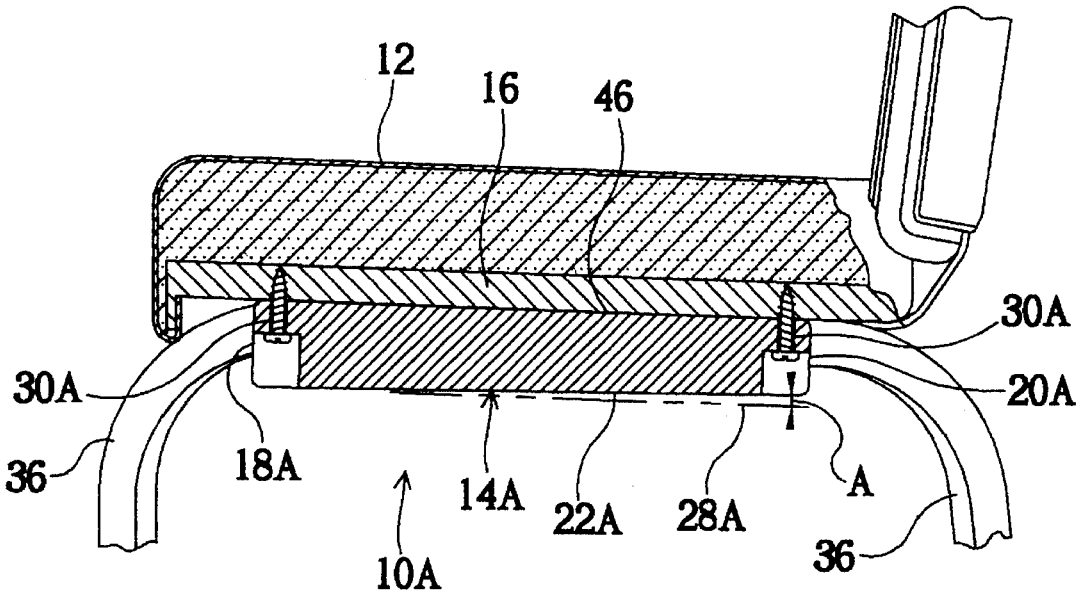
FIG. 8 illustrates a side elevation view in section, of an alternate embodiment of a stacking interface device of the present invention as installed on a chair.
Figure 9:
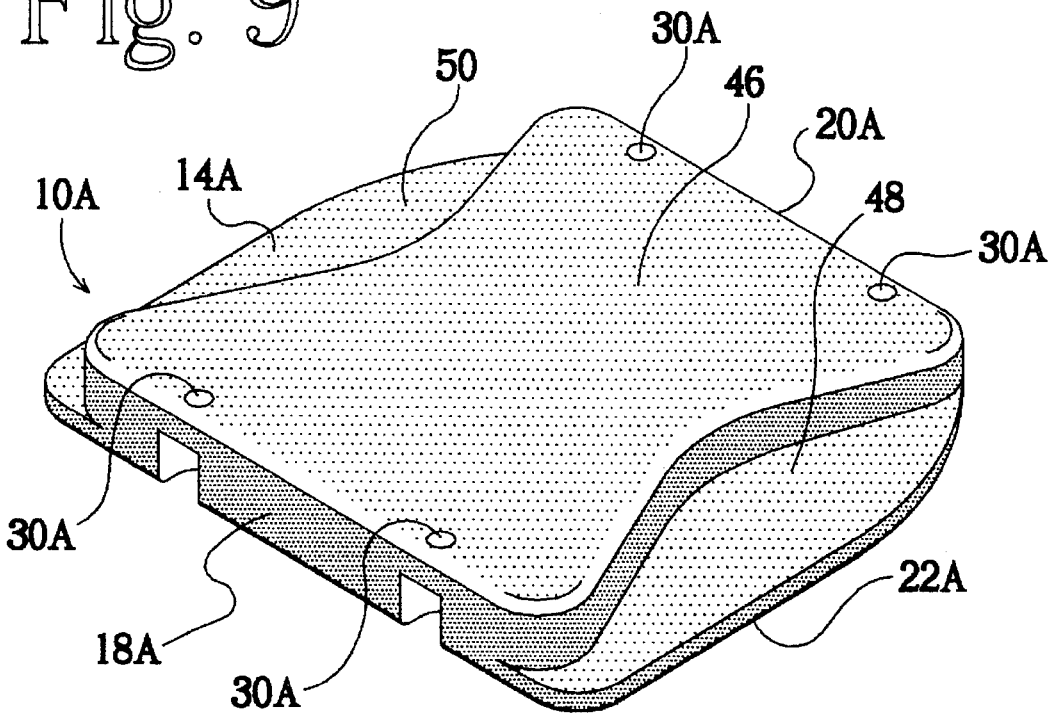
FIG. 9 illustrates a perspective view of an alternate embodiment of a stacking interface device of the present invention.

In FIGS. 8 and 9, an alternate embodiment of the stacking interface device of the present invention is illustrated at 10A. For convenience, features of the device 10A which are common to the device 10 are reference with common numerals followed by the alphabetic character "A". As illustrated, the device 10A does not carry the two spacing members 38 and 40. Instead, the interface body 14A defines an upper surface 46 which engages the lower surface 26 of the seat bottom 16, and defines recessed portions 48 and 50 which accommodate the leg members 36 such that the body 14A covers the leg members 36.

In light of the above it will be recognized that the present invention provides stacking interface device having great advantages over the prior art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A stacking interface device for being secured to a first chair and for altering a stacked disposition of the first chair relative to a second such chair upon which the first chair is stacked to facilitate stable stacking of such first chair on the second chair, each first and second chair having a seat cushion and a seat bottom defining a lower surface, said interface device comprising:

an interface body for being secured beneath the seat bottom of the first chair, said interface body having a forward portion and a rearward portion and defining a lower surface for supporting the first chair upon the seat cushion of the second chair; and a securing mechanism for securing said interface body to the first chair such that said lower surface of said interface body is disposed at an angle relative to the lower surface of the seat bottom of the first chair such that the distance between said lower surface of said interface body and the lower surface of the seat bottom of the first chair decreases from said forward portion of said interface body to said rearward portion of said interface body.

2. The stacking interface device of claim 1 wherein the first chair has leg members defining upper portions secured to the seat bottom of such first chair and wherein said interface body covers the upper portions of the leg members such that the upper portions of the leg members do not leave impressions in the seat cushion of the second chair upon which the first chair is stacked.

3. The stacking interface device of claim 2 wherein said securing mechanism includes at least two spacing members carried by said interface body for engaging the lower surface of the seat bottom of the first chair to facilitate the securing of said interface body to the lower surface of the seat bottom of the first chair whereby the upper portions of the leg members of the first chair are disposed between said interface body and the seat bottom of the first chair.

4. The stacking interface device of claim 3 wherein said interface body is provided with a plurality of holes for receiving threaded fasteners for securing said interface body to the seat bottom of the first chair.

5. The stacking interface device of claim 2 wherein said interface body defines an upper surface for engaging the lower surface of the first chair and defines recessed portions for receiving the upper portions of the leg members of the first chair whereby the upper portions of the leg members of the first chair are covered by said interface body.

6. The stacking interface device of claim 5 wherein said interface body is provided with a plurality of holes for receiving threaded fasteners for securing said interface body to the seat bottom of the first chair.

7. The stacking interface device of claim 1 wherein said securing mechanism includes at least two spacing members carried said interface body for engaging the lower surface of the seat bottom of the first chair to facilitate securing of said interface body to the lower surface of the seat bottom of the first chair.

8. A stacking interface device for being secured to a first chair and for altering a stacked disposition of the first chair relative to a second such chair upon which the first chair is stacked to facilitate stable stacking of the first chair on the second chair, each first and second chair having a seat cushion and a seat bottom defining a substantially planar lower surface, said stacking interface device comprising:

an interface body for being secured to the seat bottom of the first chair, said interface body having a forward portion and a rearward portion and defining a substantially planar lower surface for supporting the first chair upon the seat cushion of a second chair; and securing means for securing said interface body to the first chair such that said lower surface of said interface body is disposed at an angle relative to the lower surface of the seat bottom of the first chair such that the distance between said lower surface of said interface body and the lower surface of the seat bottom of the first chair decreases from said forward portion of said interface body to said rearward portion of said interface body.

9. A stacking interface device for being secured to a first chair and for altering a stacked disposition of the first chair relative to a second such chair upon which the first chair is stacked to facilitate stable stacking of the first chair on the second chair, each first and second chair having a seat cushion and a seat bottom defining a substantially planar lower surface and having leg members defining upper portions secured to the seat bottom of such chair, said stacking interface device comprising:

an interface body for being secured to the seat bottom of the first chair, said interface body having a forward portion and a rearward portion and defining a substantially planar lower surface for supporting the first chair upon the seat cushion of a second chair; and securing means for securing said interface body to the first chair such that said lower surface of said interface body is disposed at an angle relative to the lower surface of the seat bottom of the first chair such that the distance between said lower surface of said interface body and the lower surface of the seat bottom of the first chair decreases from said forward portion of said interface body to said rearward portion of said interface body, said securing means including at least two spacing members carried by said interface body for engaging the lower surface of the seat bottom of the first chair to facilitate the securing of said interface body to the lower surface of the seat bottom of the first chair whereby the upper portions of the leg members of the first chair are disposed between said interface body and the seat bottom of the first chair.

10. The stacking interface device of claim 9 wherein said interface body is provided with a plurality of holes for receiving threaded fasteners for securing said interface body to the seat bottom of the first chair.

* * * * *